US006378204B1

(12) United States Patent
Kim et al.

(10) Patent No.: US 6,378,204 B1
(45) Date of Patent: Apr. 30, 2002

(54) MANUFACTURING METHOD FOR SPLIT HEAT EXCHANGER HAVING OVAL TUBES IN ZIGZAG PATTERN

(75) Inventors: Kwang-Il Kim; Eui-Joon Kim, both of Kwangju (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/940,549

(22) Filed: Aug. 29, 2001

Related U.S. Application Data

(62) Division of application No. 09/525,031, filed on Mar. 14, 2000, now abandoned.

(30) Foreign Application Priority Data

Dec. 10, 1999 (KR) ..... 99-56490

(51) Int. Cl.[7] ..... B23P 15/26
(52) U.S. Cl. ..... 29/890.047; 29/890.043
(58) Field of Search ..... 29/890.047, 890.043, 29/525; 165/151, 182

(56) References Cited

U.S. PATENT DOCUMENTS

| | | | | | |
|---|---|---|---|---|---|
| 2,512,540 | A | * | 6/1950 | Friedman | 165/151 |
| 4,241,785 | A | * | 12/1980 | O'Connor et al. | 165/150 |
| 4,494,288 | A | * | 1/1985 | Nagai et al. | 29/890.033 |
| 4,881,311 | A | * | 11/1989 | Paulman et al. | 29/890.047 |
| 4,909,311 | A | * | 3/1990 | Nakamura et al. | 165/151 |
| 5,267,610 | A | * | 12/1993 | Culbert | 165/151 |
| 5,535,820 | A | * | 7/1996 | Beagle et al. | 165/150 |
| 5,704,123 | A | * | 1/1998 | Paulman et al. | 165/150 |
| 5,765,284 | A | * | 6/1998 | Ali et al. | 29/890.047 |
| 5,954,125 | A | * | 9/1999 | Mantegazza et al. | 165/149 |
| 6,167,619 | B1 | * | 1/2001 | Beagle | 29/727 |

FOREIGN PATENT DOCUMENTS

| | | | | |
|---|---|---|---|---|
| DE | 2509715 | * | 9/1976 | 165/151 |
| JP | 0202495 | * | 12/1982 | 165/151 |
| JP | 0173694 | * | 10/1984 | 165/151 |
| JP | 0251394 | * | 12/1985 | 165/151 |
| JP | 0116293 | * | 6/1986 | 165/151 |
| JP | 0143695 | * | 7/1986 | 165/151 |
| JP | 0191892 | * | 8/1986 | 165/151 |
| JP | 0240099 | * | 10/1986 | 165/151 |
| JP | 0243295 | * | 10/1986 | 165/151 |
| JP | 61268988 | | 11/1986 | |
| JP | 0180091 | * | 7/1988 | 165/151 |
| JP | 0259394 | * | 10/1990 | 165/151 |
| JP | 404371797 | * | 12/1992 | 165/151 |
| JP | 405087481 | * | 4/1993 | 165/151 |
| JP | 405164488 | * | 6/1993 | 165/151 |

* cited by examiner

*Primary Examiner*—I Cuda-Rosenbaum
(74) *Attorney, Agent, or Firm*—Larson & Taylor PLC

(57) ABSTRACT

A method for manufacturing a heat exchanger for a cooling cycle includes the steps of: preparing the pipes and the fins having through-holes through which the pipes are inserted, arranging the fins parallel depth-wise and in several separate groups depth-wise and then inserting the pipes through the through-holes of the fin groups, bending the outer portions of the pipes so that the fin groups separated from each other are piled in layers along the longitudinal direction of air flow and the inner portions of the pipes are arranged in at least two coplanar rows along the longitudinal direction of air flow, and wrenching the bending portion of the pipes to form each pipe row into a zigzag shape.

7 Claims, 14 Drawing Sheets

MANUFACTURING METHOD FOR SPLIT HEAT EXCHANGER HAVING OVAL TUBES IN ZIGZAG PATTERN

CROSS REFERENCE TO RELATED APPLICATION

This application is a division of Ser. No. 09/525,031 filed Mar. 14, 2000 abandonded.

FIELD OF THE INVENTION

The present invention relates to a heat exchanger and manufacturing method thereof and, more particularly, to a split heat exchanger having oval tubes for a cooling cycle and a manufacturing method thereof and in which several fin groups are arranged in layers with the tubes forming pipe rows having a zigzag pattern.

BACKGROUND OF THE INVENTION

Heat exchangers are generally used in air conditions, refrigerators, etc. to carry out heat exchange between external air passing over fins and the external surface of pipes thereof through which refrigerant flows. Generally, there are split-fin type heat exchangers in which a plurality of fins are arranged depth-wise in parallel with each other and additionally in groups and the fin groups are piled longitudinally in layers, and integral-fin type heat exchangers in which a plurality of fins are arranged depth-wise in parallel with each other in one layer.

A conventional split-fin type heat exchanger 1, as shown in FIG. 1, comprises a plurality of plate-shaped fins 3 disposed depth-wise in parallel with each other and refrigerant pipes 2 passing through the fins 3 numerous times by being bent in a U-shape.

As shown in FIG. 2, the fins 3 are arranged in layers along the longitudinal direction of air flow (shown by the arrow F in the drawing). A couple (two) of through-holes 3*a*, through which the pipes 2 are inserted, are provided by perforation on the respective fins 3. Each pipe 2 is hollow and cylindrical, and passes through the fins 3 from the longitudinally uppermost fin group to the lowermost fin group by being bent depth-wise in a series of U-shapes. In the heat exchanger, there are two longitudinal pipe rows of the two pipes 2 which are held separated from each other in a lateral direction by the fins 3. Each pipe row of a pipe 2 is arranged in a single plane along the longitudinal direction of air flow. Reference numeral 4 is a defrosting heater.

In order to assemble such a conventional split-fin type heat exchanger 1, a plurality of fins 3 in which a couple of through-holes 3*a* have been perforated are arranged depth-wise in parallel with each other, and then a couple of pipes 2 penetrate the fins 3 depth-wise through the respective through-holes 3*a*. At this stage, the fins 3 are arranged depth-wise in several groups, the fin groups having inner pipe portions therein and being separated depth-wise from each other at predetermined intervals by outer pipe portions. Then, the pipe outer portions which are located between the fin groups are bent depth-wise in a U-shape so that the fin groups are piled in layers in a longitudinal direction of the heat exchanger 1. After this, the openings of the two pipes 2 at the lower longitudinal end are welded so as to connect the pipes 2 into a single flow path.

However, in the above prior art heat exchanger 1, as shown in FIG. 2, since each pipe row is arranged in a single plane along the longitudinal direction of air flow, external air which flows longitudinally between and outside of the pipe rows of the pipes 2 passes through the heat exchanger 1 without effectively contacting the pipe portions of pipes 2. In addition, after external air which is forwarded toward the bottom of the heat exchanger 1 contacts the lowermost pipe portions, the air is mostly dispersed or channeled as shown by the flow arrows and bypasses the above pipe portions which are adjacent to the lowermost pipe portions. As a result, heat exchange efficiency is greatly decreased.

Further, because the pipe 2 is formed in a cylindrical shape, the amount of space provided for the passage of air is limited such that air directed toward the heat exchanger 1 by a fan (not shown) in the longitudinal direction of the arrows in FIG. 2 loses much of its force by pressure loss, and consumption power and operating noise of the fan are increased. Also, condensed water generated during the defrosting process tends to be suspended on a bottom surface of the pipes 2 and thus the pipe may be frosted immediately after the cooling cycle begins to operate again.

BRIEF SUMMARY OF THE INVENTION

The present invention has been made in an effort to solve the above problems.

It is an objective of the present invention to provide a heat exchanger named SOFT (Split, Oval, Fin & Tube) evaporator and manufacturing method thereof in which arrangement of a pipe is improved to enhance heat exchange efficiency by increasing air contact area with the pipe.

It is another objective of the present invention to provide a heat exchanger named SOFT (Split, Oval, Fin & Tube) evaporator and manufacturing method thereof in which the shape of a pipe is improved to reduce the pressure loss of air flowing into a heat exchanger and to make condensed water exhausted more easily therefrom.

To achieve the above objectives, the present invention provides a heat exchanger, for example for a cooling cycle, comprising a plurality of fins which are arranged depth-wise in parallel with each other and pipes which pass through the fins. The fins are arranged depth-wise in groups and the fin groups are piled in layers along the longitudinal direction of air flow. The pipes pass through the fin groups by being bent numerous times at bent portions thereof and the inner portions of the pipes in the fin groups form at least two rows along the longitudinal direction of air flow. The inner pipe portions of each pipe row are arranged in a zigzag shape, pattern or progression.

The pipe is preferably oval or elliptically-shaped in cross section to have a short axis and a long axis, and the pipe passes through the fin groups in such a manner that the long axis of the pipe is parallel to the longitudinal direction of air flow.

Preferably, the ratio of a length of the long axis of the pipe to a length of the short axis is in the range of 1.3–1.7.

More preferably, auxiliary plates, having fixing holes through which the bending portion of the pipes are inserted, are fixedly mounted to the front and rear of the layered fin groups.

According to another aspect of the present invention, a method for manufacturing a heat exchanger, for example for a cooling cycle, comprises the steps of: preparing the pipes and the fins having through-holes through which the pipes are inserted; arranging the fins depth-wise in several separated groups and inserting the pipes through the through-holes of the fin groups; bending the outer pipe portions of the pipes located between the fin groups so that the fin groups separated from each other are piled in layers along the longitudinal direction of air flow and so that the inner pipe portions of the pipes in the fin groups are arranged in at least two rows along the longitudinal direction of air flow; and wrenching the bent portions of the pipes to form each pipe row into a zigzag shape.

The preparing step further comprises the step of forming the pipe in an oval or elliptical shape which has a short axis and a long axis, and the fin arranging step further comprises the step of inserting the pipe into the fin groups with the long axis of the pipe parallel to the longitudinal direction of air flow.

In addition, the preparing step further comprises the step of forming the through-holes on a portion biased in a lateral direction from a longitudinal center of the fin, and the fin arranging step further comprises the step of alternately arranging the fin groups to have the through-holes formed on a laterally left-biased portion thereof and the fin groups formed on a laterally right-biased portion thereof.

The method for manufacturing a heat exchanger further comprises the steps of forming a burr on the surrounding portion of each through-hole to provide a surface contact thereof with the outer circumferential surface of the pipe subsequently inserted therethrough; expanding each pipe so that the outer circumferential surface of the pipe adheres closely to the inner circumferential surface of the associated through-hole between the fin arranging step and the pipe bending step; and fixedly mounting respective auxiliary plates, having fixing holes through which the bending portion of the pipes are inserted, to the front and rear of the heat exchanger after the wrenching step.

BRIEF DESCRIPTION OF THE SEVERAL VIEWS OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE INVENTION

A preferred embodiment of the present invention will now be described in detail with reference to the accompanying drawings.

Figure 3:
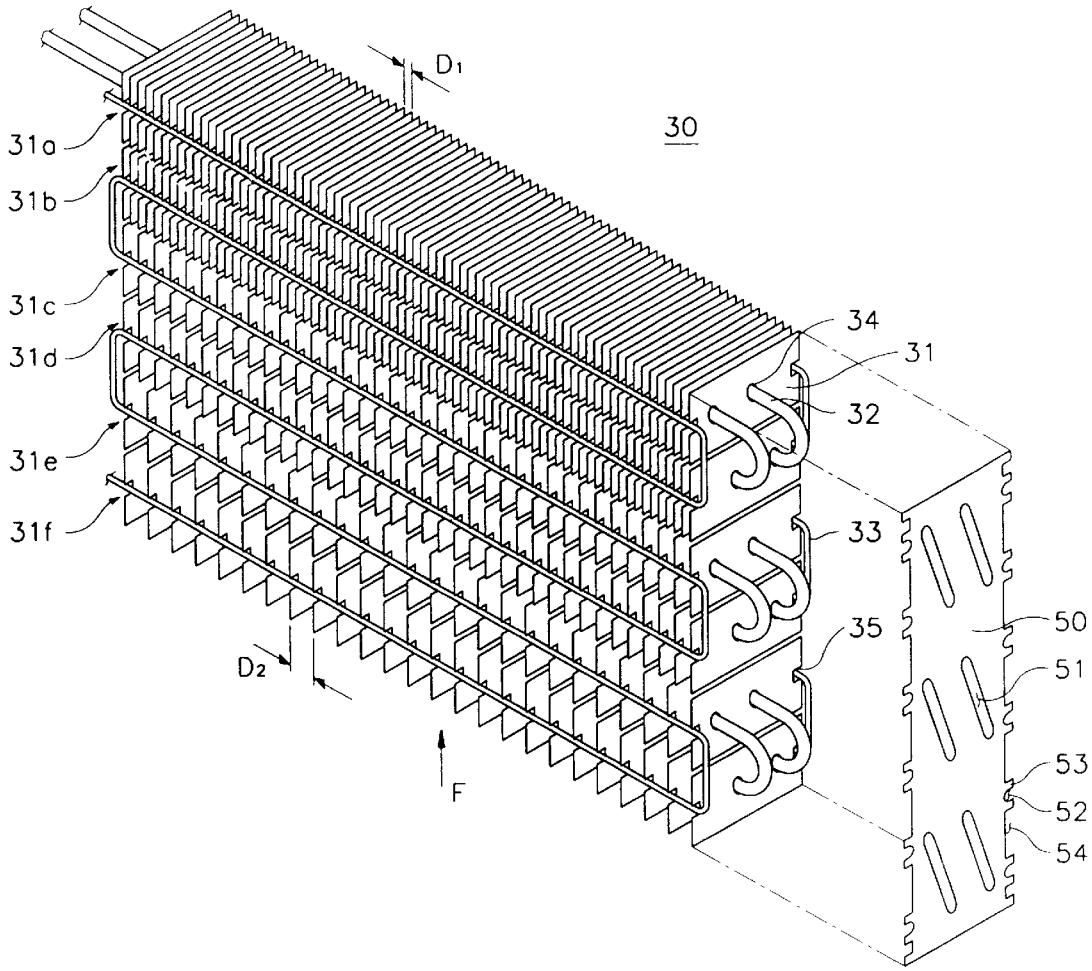
FIG. 3 is a perspective view of a heat exchanger for a cooling cycle according to a preferred embodiment of the present invention.
Figure 4:
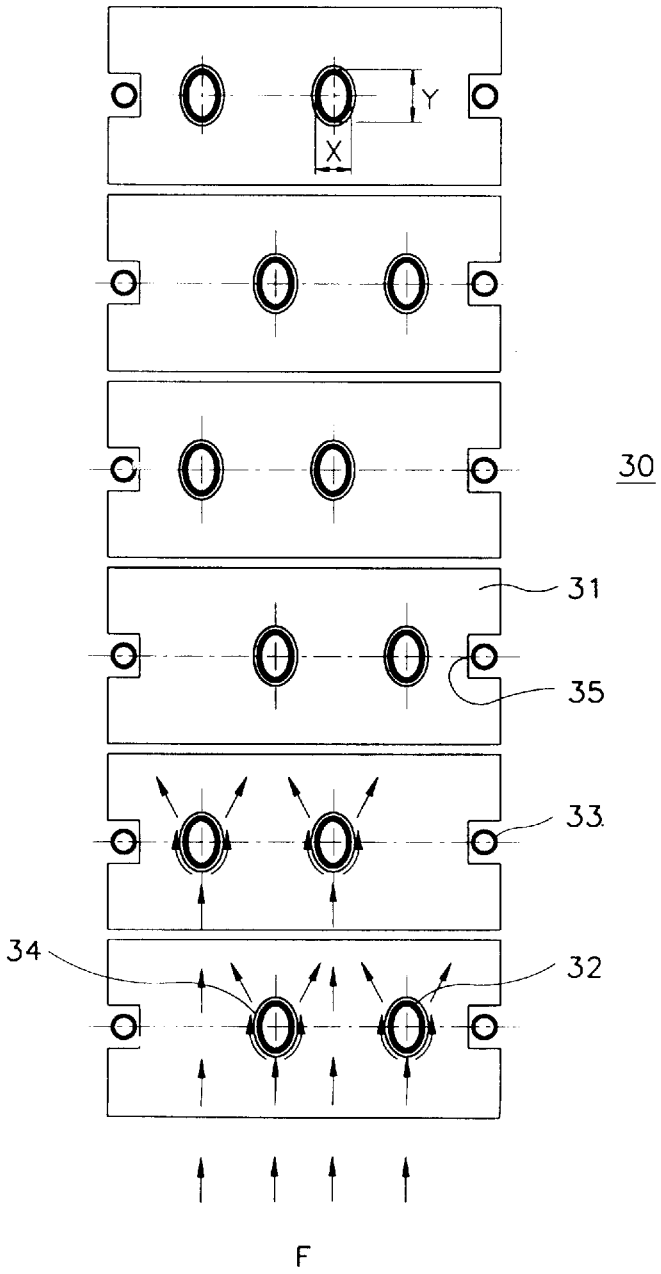
FIG. 4 is a sectional view of a heat exchanger according to a preferred embodiment of the present invention, illustrating air flow therethrough.

FIGS. 3 and 4 respectively are a perspective view and a sectional view of a split heat exchanger having two oval pipes each disposed in a zigzag pattern according to a preferred embodiment of the present invention.

As shown in FIG. 3, a split-fin type heat exchanger 30 according to the present invention includes a plurality of fin groups 31*a*, 31*b*, 31*c*, 31*d*, 31*e*, 31*f* which are longitudinally (vertically as depicted) piled in layers. Respective fin groups 31*a*, 31*b*, 31*c*, 31*d*, 31*e*, 31*f* comprise a plurality of fins 31 which are depth-wise arranged parallel to each other. At least two refrigerant pipes 32 having inner pipe portions which pass through the uppermost fin group 31*a*, and the pipes 32 then have outer pipe portions which are bent depth-wise in a U-shape such that subsequent inner pipe portions pass through the below fin group 31*b* which is adjacent to the uppermost fin group 31*a*. In this manner, the pipes 32 pass through all fin groups 31*a*, 31*b*, 31*c*, 31*d*, 31*e*, 31*f*.

The depth-wise interval D2 between the fins in the lowermost fin group 31*f* is larger than the depth-wise interval D1 in the uppermost fin group 31*a* because a frost build-up occurs mainly in the lowermost fin group 31*f*, i.e. the air intake side, when humid air is directed longitudinally (upwards as shown) toward the heat exchanger 30 as shown by the arrow F in the drawing.

A defrosting heater 33 is mounted in a recess 35 which is formed in a lateral side portion of each fin 31.

Referring to FIG. 4, at least two through-holes 34 through which the pipes 32 are depth-wise inserted are provided by perforation or the like on respective fins 31. The through-holes 34 are formed on a portion biased in a lateral direction from the longitudinal center of each fin 31. Further, the fin groups alternate with the fins 31 having the through-holes 34 which are formed on left-biased portions thereof and then with the fins having the through-holes 34 which are formed on right-biased portions thereof. As a result, each longitudinal pipe row of the inner pipe portions of each pipe 32 which penetrate all fin groups 31*a*, 31*b*, 31*c*, 31*d*, 31*e*, 31*f* through the through-holes 34 has a zigzag shape or progression in a longitudinal direction of the heat exchanger 30. Accordingly, external air passing longitudinally over the heat exchanger 30 contacts most pipe portions of pipes 32 without bypassing or being deflected away therefrom by the lower pipe portions, thereby the heat exchange efficiency is enhanced as will be described in detail later.

In order that each longitudinal pipe row is arranged in a longitudinal zigzag shape or progression, the U-shaped bent outer pipe portions of the pipes 32 which are disposed between respective fin groups 31*a*, 31*b*, 31*c*, 31*d*, 31*e*, 31*f* should be maintained in a wrenched or twisted state at a predetermined slant, as shown in FIG. 3. For this, auxiliary plates 50 having fixing holes 51 through which the bent outer pipe portions of the pipes 32 are inserted are respectively mounted to the front and rear of the heat exchanger 30. Also, a plurality of mounting recesses 52 for fixing the defrosting heater 33 are provided at lateral side portions of the auxiliary plate 50, each mounting recess 52 being formed by a couple of protrusions 53. Provided between respective mounting recesses 52 are spaces 54. Thus, after the bent outer pipe portions of the pipes 32 are inserted through the fixing holes 51 and the defrosting heater 33 is inserted into the mounting recesses 52, a couple of protrusions 53 forming the mounting recess 52 are bent or deformed onto the defrosting heater 33 as shown. As a result, the auxiliary plates 50 are mounted to the depth-wise front and rear of the heat exchanger 30, and thereby the bent outer pipe portions of the pipes 32 are maintained in a wrenched or twisted state at a predetermined slant by the fixing holes 51 of the auxiliary plate 50.

Figure 1:
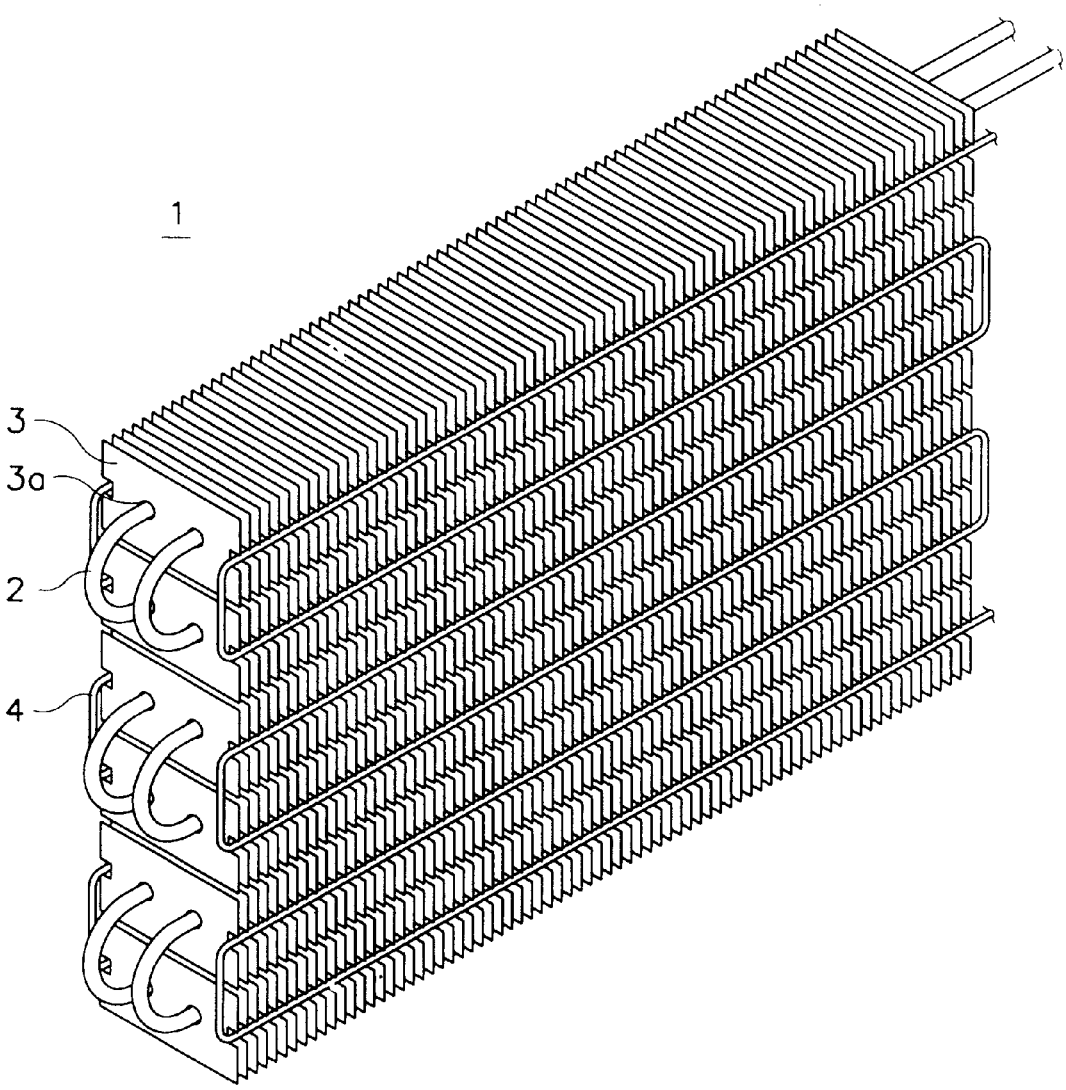
FIG. 1 (PRIOR ART)
FIG. 1 is a perspective view of a conventional heat exchanger for a cooling cycle.
Figure 2:
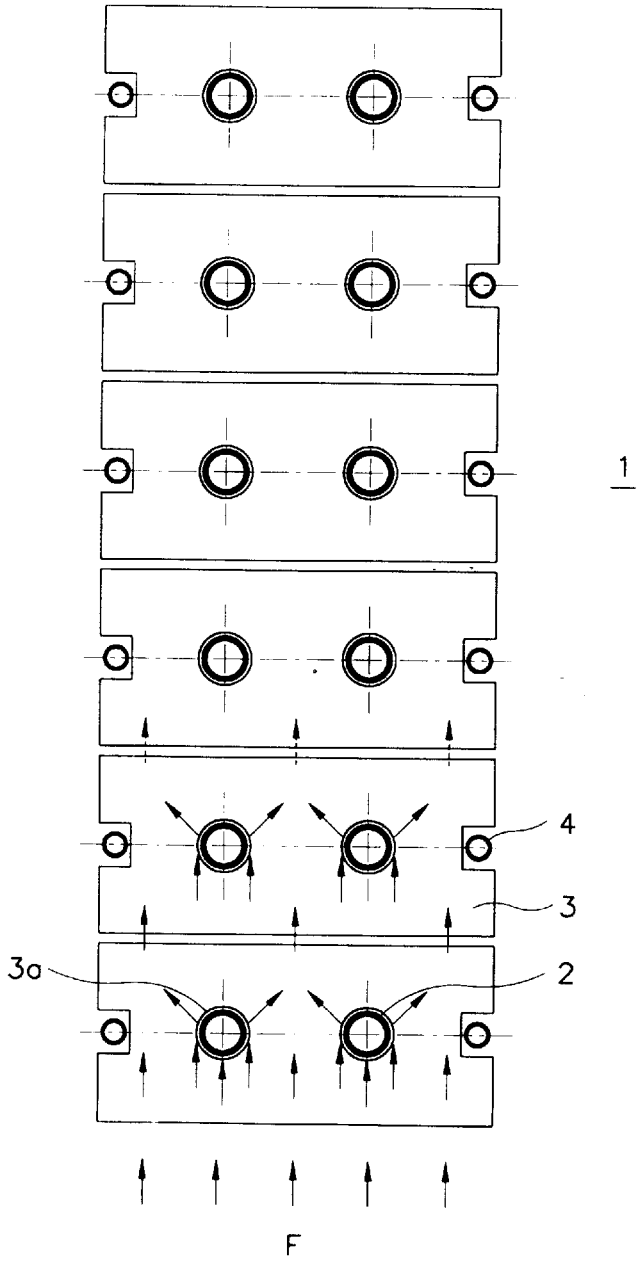
FIG. 2 (PRIOR ART)
FIG. 2 is a sectional view of a conventional heat exchanger, illustrating air flow therethrough.

In addition, each through-hole 34 is formed in an elliptical or oval shape such that a longitudinal axis of the through-hole 34, which is parallel to the direction of air flow (shown by the arrows F to the bottom of the heat exchanger 30 in the drawing), is longer than a lateral axis. Similarly, each hollow pipe 32 is elliptically-shaped in cross section, and thus has a short axis X and a long axis Y (see FIG. 6). When the pipe 32 is inserted through the through-hole 34, the long axis Y of the pipe 32 is disposed parallel to the longitudinal direction of air flow. As a result, condensed water generated on the surface of the pipes 32 during the defrosting process is better exhausted from the pipes 32, and the pressure loss of air is reduced since the passage for the air between two pipes 32 becomes broader (has a greater cross section) as compared with the conventional heat exchanger 1 (see FIG. 2). It is preferable that the ratio of a length of the long axis Y to a length of the short axis X is in the range of 1.3–1.7. The above ratio is 1.5 in this preferred embodiment.

The manufacturing method of the heat exchanger 30 according to the present invention will be described hereinafter with reference to FIGS. 5 to 13.

Figure 5:
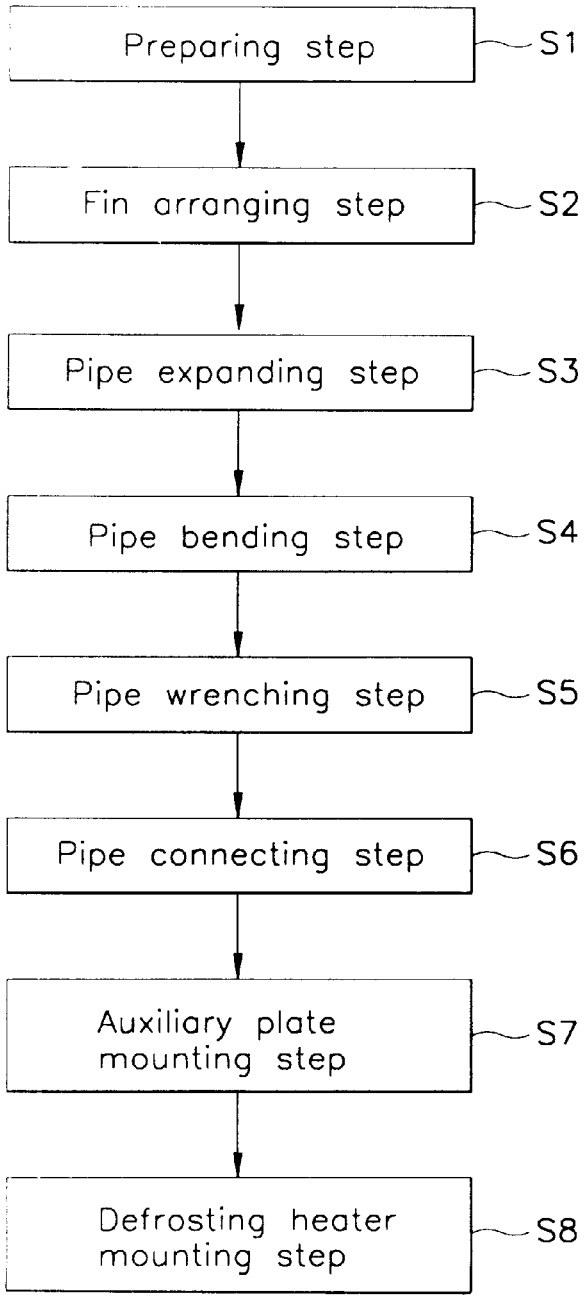
FIG. 5 is a block diagram illustrating a manufacturing method of a heat exchanger according to a preferred embodiment of the present invention.

As shown in FIG. 5, the manufacturing method of the inventive heat exchanger 30 includes:

- a step S1 of preparing a plurality of fins 31 and at least two pipes 32,
- a step S2 of arranging the fins 31 in several groups 31*a*, 31*b*, 31*c*, 31*d*, 31*e*, 31*f* separately and inserting the pipes 32 through the fin groups 31*a*, 31*b*, 31*c*, 31*d*, 31*e*, 31*f*,
- a step S3 of outwardly expanding the pipes 32 which are inserted through the fins 31,
- a step S4 of bending the outer pipe portions of the pipes 32 such that the fin groups 31*a*, 31*b*, 31*c*, 31*d*, 31*e*, 31*f* separated from each other are piled or stacked in layers,
- a step S5 of wrenching or twisting the bent outer pipe portions of the pipes 32 to form the longitudinal pipe row of inner pipe portions of each pipe in a zigzag shape or progression,
- a step S6 of connecting one set of adjacent ends of the pipes 32 to each other,
- a step S7 of mounting auxiliary plates 50 to the front/rear of the fin groups 31*a*, 31*b*, 31*c*, 31*d*, 31*e*, 31*f* so as to fix the bent outer pipe portions of the pipes 32, and
- a step S8 of mounting a defrosting heater 33.

Figure 6:
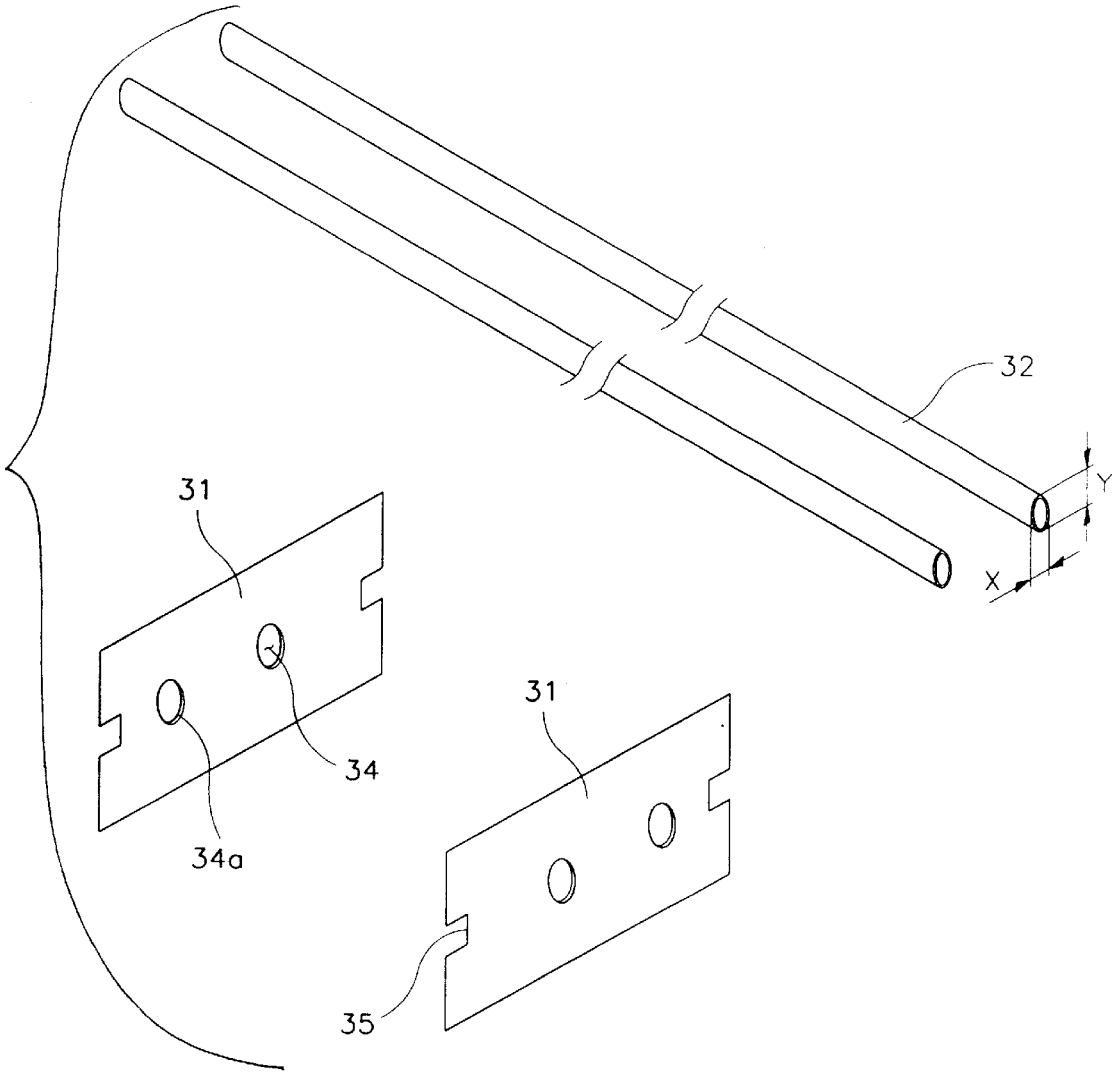
FIG. 6 shows a preparing step in a manufacturing method of a heat exchanger.

In the preparing step S1, as shown in FIG. 6, a couple of pipes 32 of a predetermined length and a plurality of plate-shaped fins 31 are prepared. Each pipe 32 is hollow and elliptically-shaped in cross section to have a short axis X and a long axis Y. Such pipes 32 are formed by a conventional drawing machine (not shown). A couple or pair of through-holes 34 are formed by perforating each respective fin 31. Each through-hole 34 is formed in an elliptical shape and is slightly larger than the size of the pipe 32, such that when the long axis Y of the pipe 32 is disposed parallel to the direction of air flow (see FIG. 4), the pipe 32 can be easily inserted through the aligned through-holes 34. The through-holes 34 are formed on a portion of the fin 31 biased in a lateral direction from the longitudinal center of each fin 31. It will be appreciated that on the surrounding portion of each through-hole 34, a burr 34*a* is formed by a burring process. As a result of this burring process, the outer circumferential surface of the pipe 32 will develop a surface contact with the inner circumferential surface of the through-hole 34 during the pipe expanding step S3 which will be described later, and with this surface contact the heat exchange efficiency is enhanced.

Figure 7:
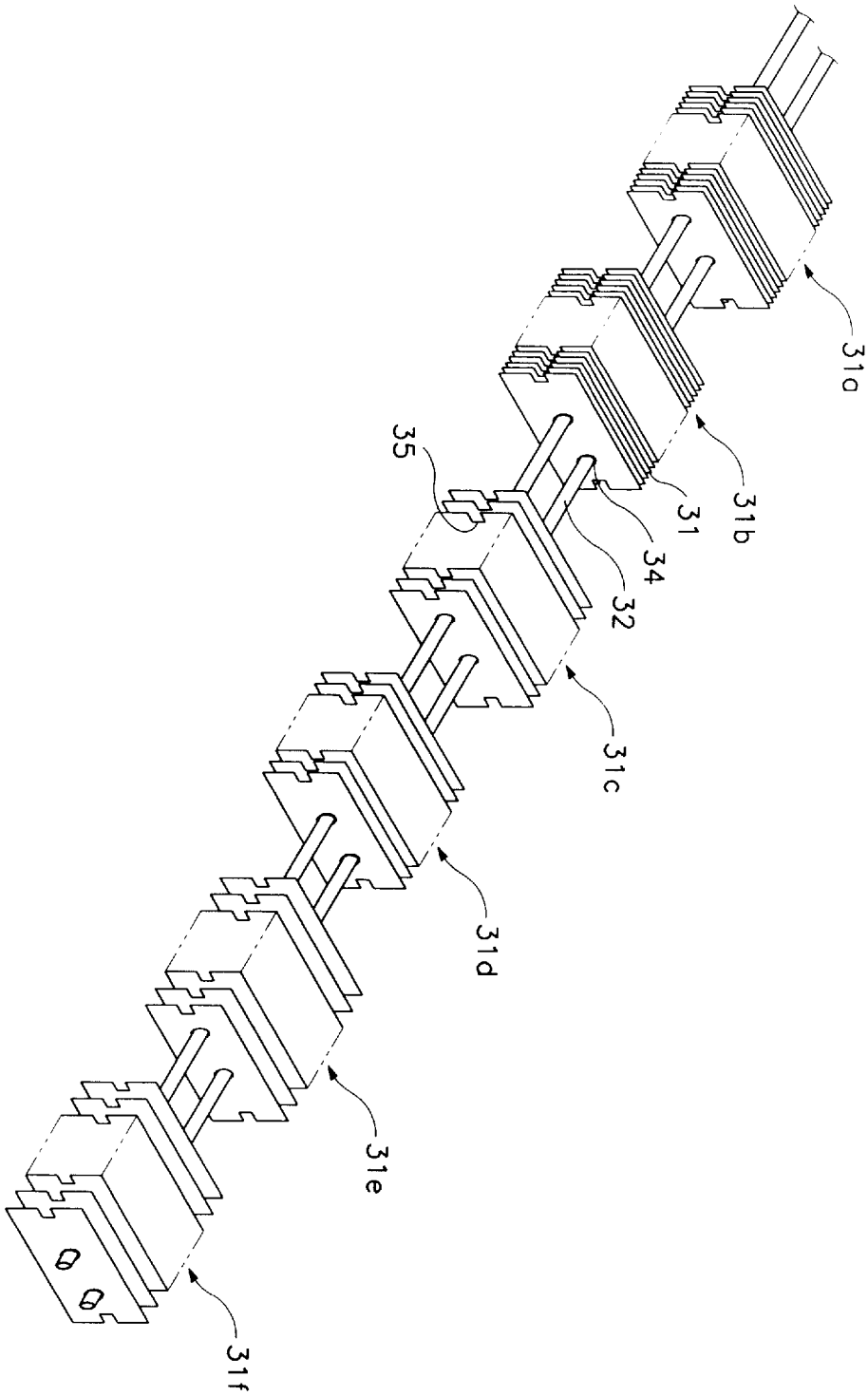
FIG. 7 shows a fin arranging step in a manufacturing method of a heat exchanger.

In the fin arranging step S2, as shown in FIG. 7, the fins 31 are disposed parallel to each other by a jig (not shown) and the elliptical pipes 32 are mounted to the fins 31 through the through-holes 34. Before insertion, it will be appreciated that the fins 31 are arranged in several groups 31*a*, 31*b*, 31*c*, 31*d*, 31*e*, 31*f*, and such fin groups 31*a*, 31*b*, 31*c*, 31*d*, 31*e*, 31*f* are separated from each other by predetermined intervals and arranged with alternate lateral biases. In particular, for example, the fin groups 31*a*, 31*c*, 31*e* comprise the fins having a couple of through-holes 34 which are formed on portions biased to the left from the longitudinal center of each fin, while the fin groups 31*b*, 31*d*, 31*f* comprise the fins having the through-holes 34 which are formed on right portions thereof and hence which are arranged alternately with the fin groups 31*a*, 31*c* and 31*e*.

Figure 8:
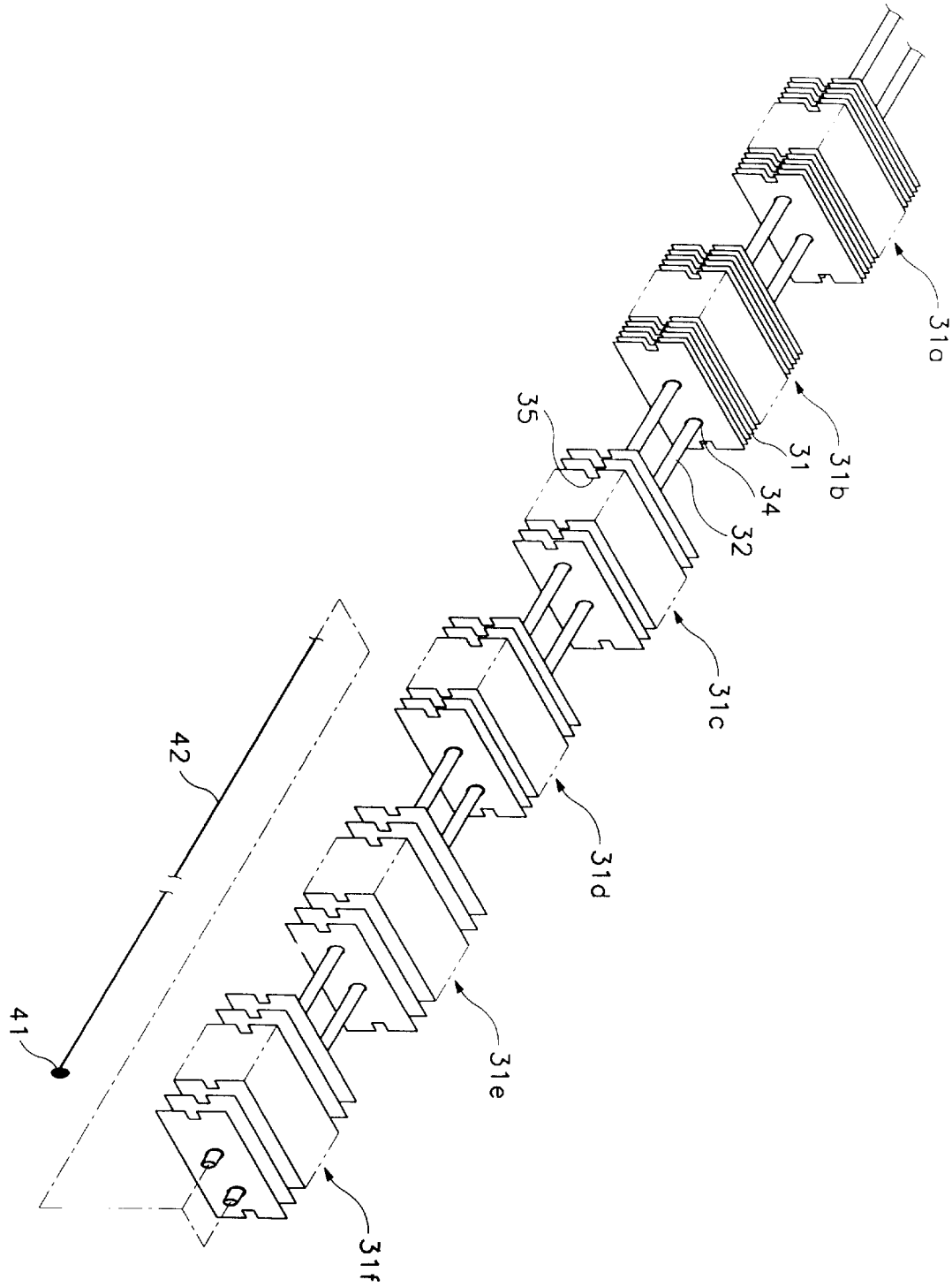
FIG. 8 shows a pipe expanding step in a manufacturing method of a heat exchanger.

In the pipe expanding step S3, the pipes 32 are expanded after the fin arranging step S2 to make the outer circumferential surface of each pipe 32 a surface contact with the burr 34*a* formed on the associated through-hole 34. To accomplish this, as shown in FIG. 8, a steel wire 42 having an elliptical rigid body 41 coupled on one end thereof is inserted into one end of the pipe 32. Then the wire 42 is pulled forcedly so that the rigid body 41 passes through the inside of the pipe 32. As a result of the passage of rigid body 41, the pipe 32 is expanded and adheres closely to the burr 34*a* formed on the circumferential surface of the associated through-hole 34. For best results, it is preferable that the size of the elliptical rigid body 41 be slightly larger than the inner size of the pipe 32.

Figure 9:
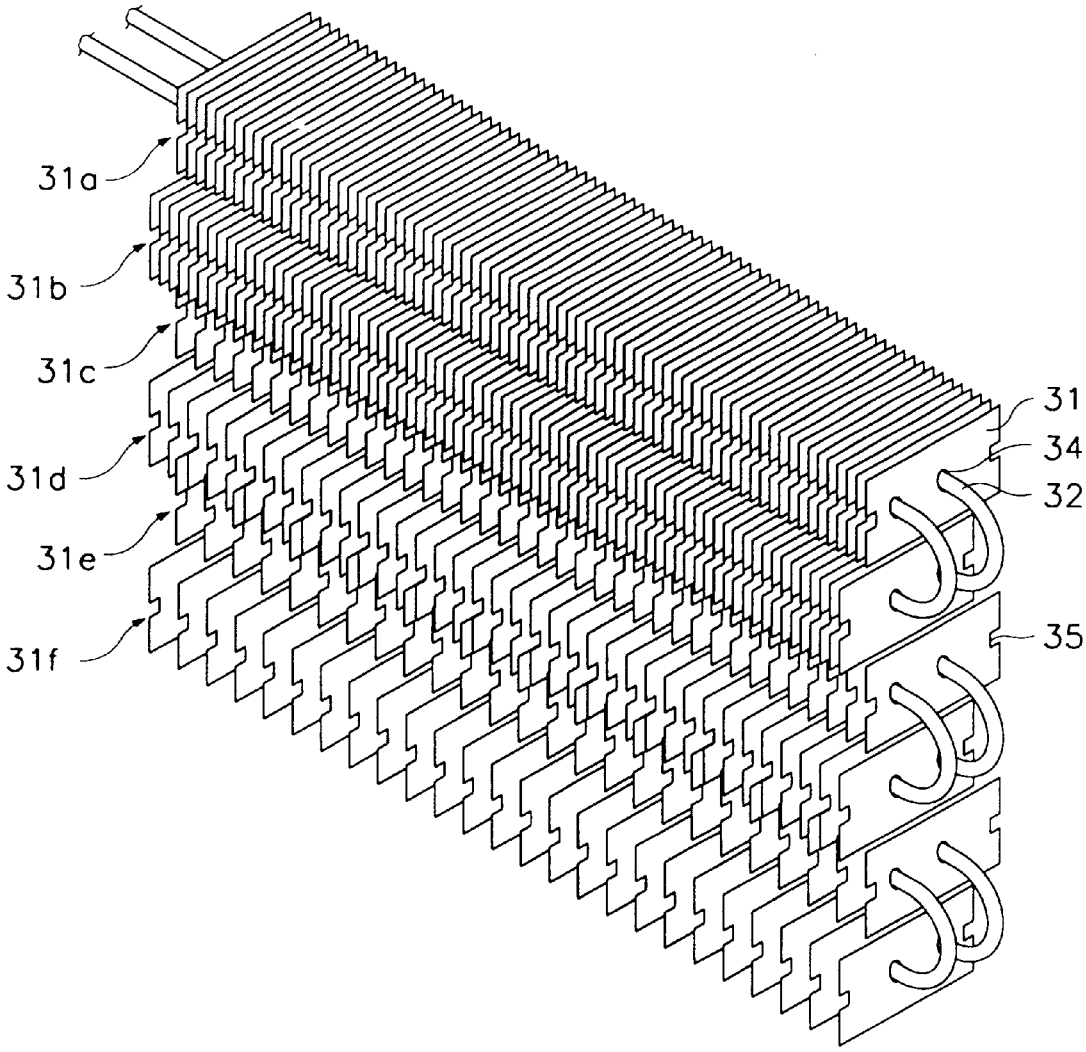
FIG. 9 shows a pipe bending step in a manufacturing method of a heat exchanger.

In the pipe bending step S4, the outer pipe portions located between respective fin groups 31*a*, 31*b*, 31*c*, 31*d*, 31*e*, 31*f* are bent after the pipe expanding step S3. In particular, the fin groups 31*a*, 31*b*, 31*c*, 31*d*, 31*e*, 31*f* are piled in layers in the longitudinal direction by successively bending the outer pipe portions located between respective fin groups 31*a*, 31*b*, 31*c*, 31*d*, 31*e*, 31*f* in a U-shape, as shown in FIG. 9. At this stage, consistent with the fin arranging step S2, the fin groups 31*a*, 31*c*, 31*e* and the fin groups 31*b*, 31*d*, 31*f* are piled in alternate (zigzag) layers due to the position of the through-holes 34 formed on a left or right biased portion of the respective fins 31 (but note that the pipe row of each pipe 32 is longitudinally coplanar).

Figure 10:
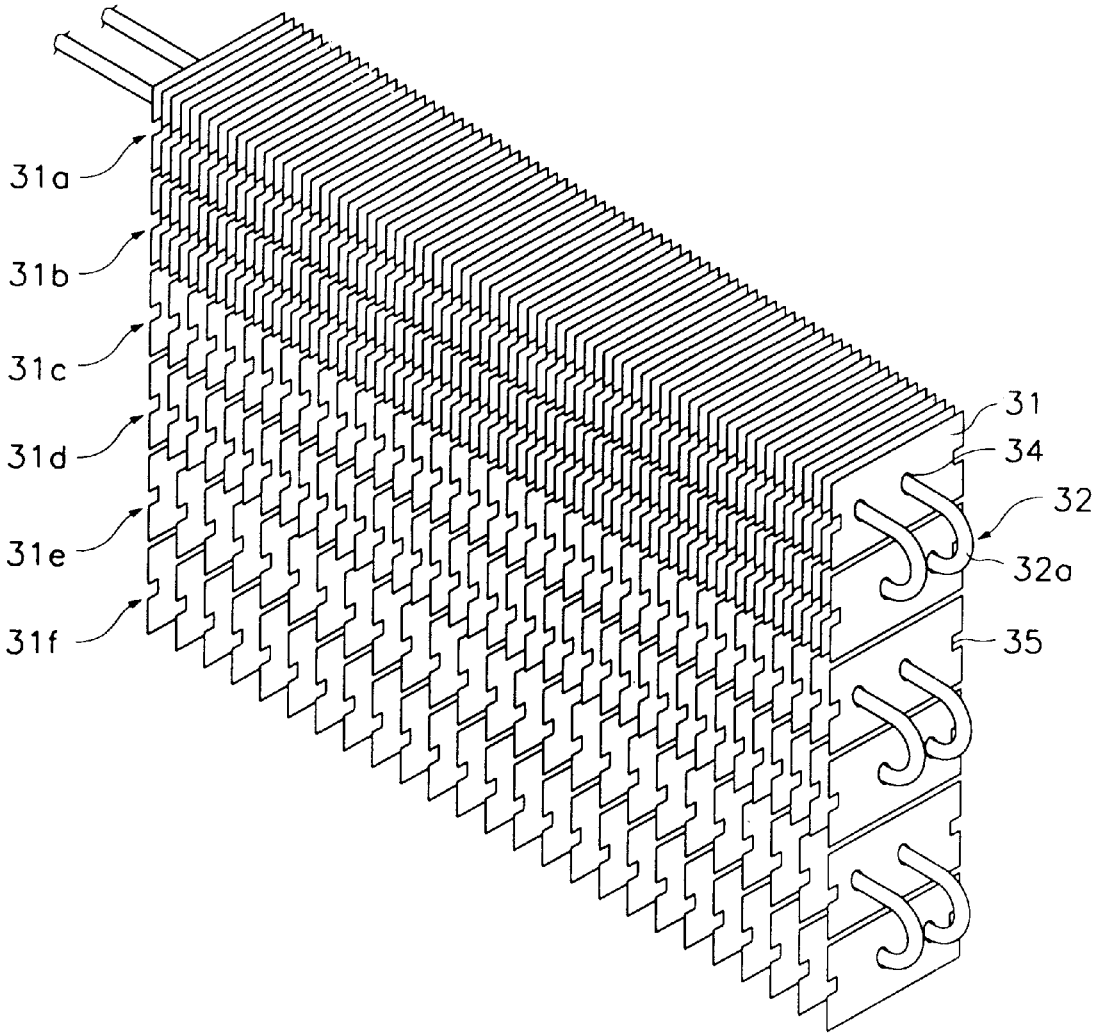
FIG. 10 shows a pipe wrenching step in a manufacturing method of a heat exchanger.

Subsequently, in the pipe wrenching or twisting step S5, as shown in FIG. 10, the bent outer pipe portions 32*a* of each pipe 32 are forcibly wrenched or twisted by a jig (not shown) so that the fin groups 31*a*, 31*b*, 31*c*, 31*d*, 31*e*, 31*f*, which were piled in alternate (zigzag) layers during the pipe bending step S4, are aligned longitudinally with each other (i.e., have coplanar side portions). At the same time, each pipe row formed by respective inner pipe portions penetrating a respective fin group 31*a*, 31*b*, 31*c*, 31*d*, 31*e*, 31*f* is formed in a zigzag shape or progression in the longitudinal direction of the heat exchanger 30 (the pipe row is no longer coplanar). It will be appreciated that the long axis Y of the pipe 32 is still disposed or maintained parallel to the direction of air flow (see FIG. 4) even after step 55.

Figure 11:
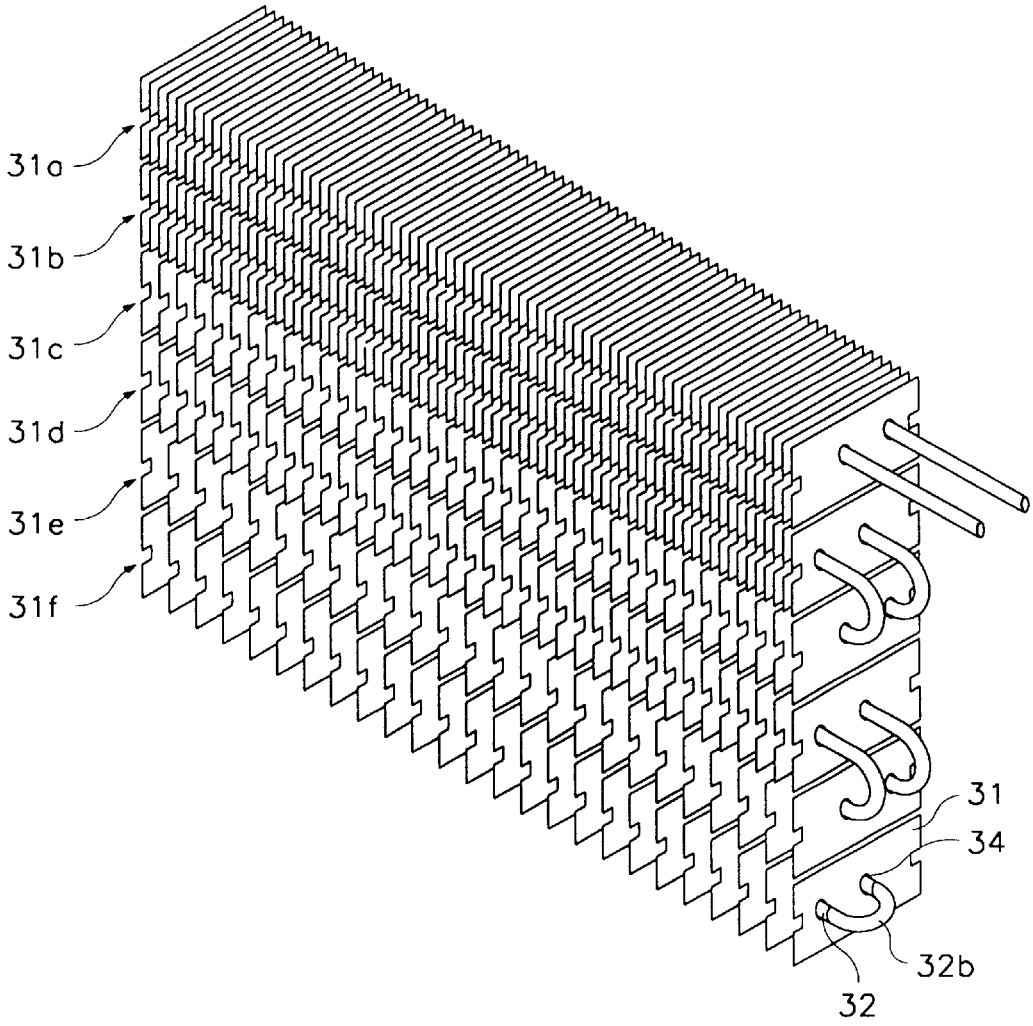
FIG. 11 shows a pipe connecting step in a manufacturing method of a heat exchanger.

In pipe connecting step S6, the openings of two pipes 32 at one (lower) end are connected by welding so as to realize a single loop of a flow path such as for a coolant. As shown in FIG. 11, a U-shaped connecting pipe 32*b* is conveniently welded to respective openings of the pipes 32 exposed outside of the lowermost fin group 31*f* so that the two pipes 32 are communicated with each other.

Figure 12:
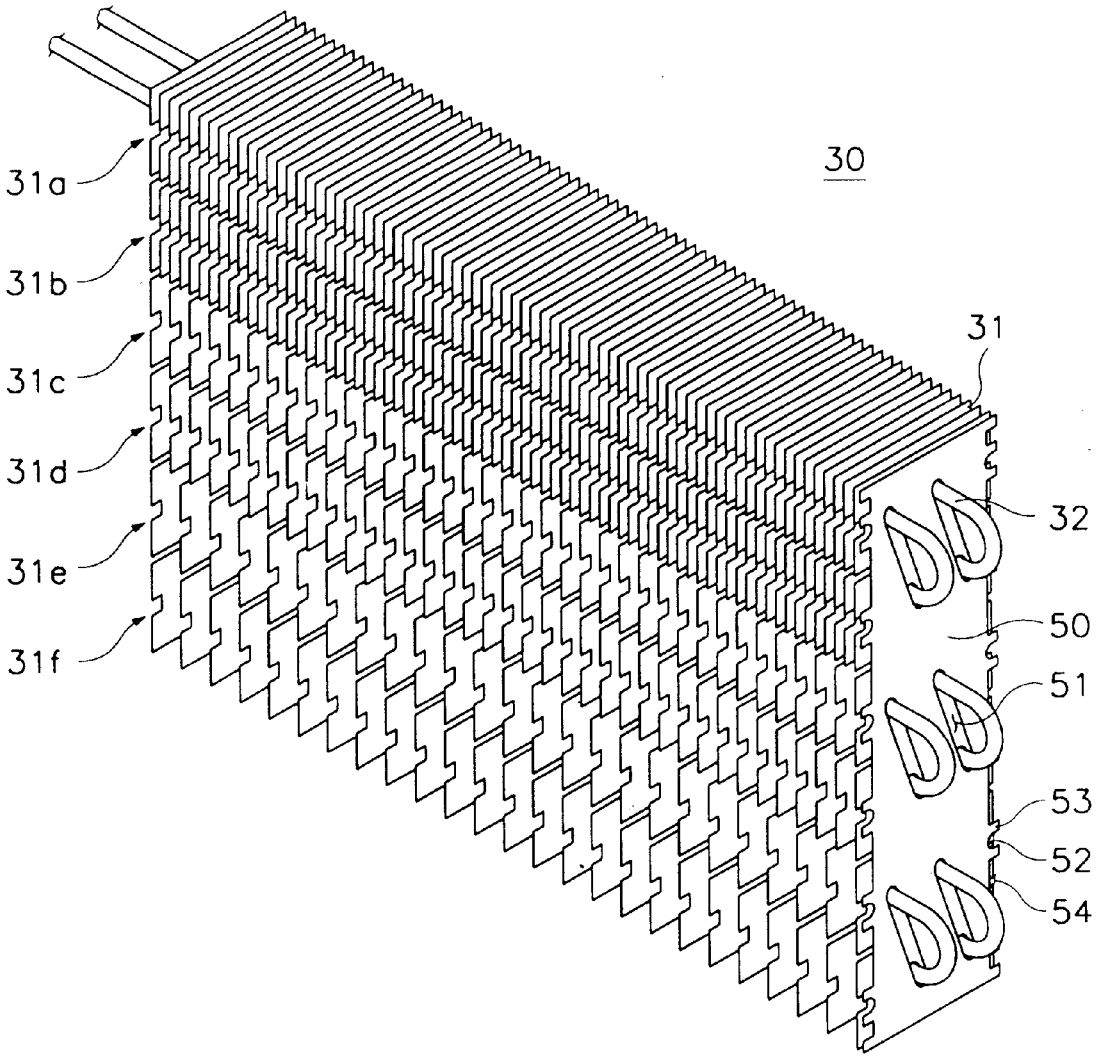
FIG. 12 shows an auxiliary plate mounting step in a manufacturing method of a heat exchanger.

In the auxiliary plate mounting step S7, auxiliary plates 50 are mounted to the front and rear of the fin groups 31*a*, 31*b*, 31*c*, 31*d*, 31*e*, 31*f* so as to fix the U-shaped bent outer pipe portions 32*a* of the pipes 32 in a predetermined slant which was set during the pipe wrenching step S5. For this mounting, as shown in FIG. 12, fixing holes 51 through which the bent outer pipe portions 32*a* of the pipes 32 are inserted have been provided as perforations in each auxiliary plate 50. Also, a plurality of mounting recesses 52 for fixing therein the defrosting heater 33 are provided at a side portion of each auxiliary plate 50. Each mounting recess 52 is formed by a couple of protrusions 53 and spaces 54 are provided between respective mounting recesses 52.

Figure 13:
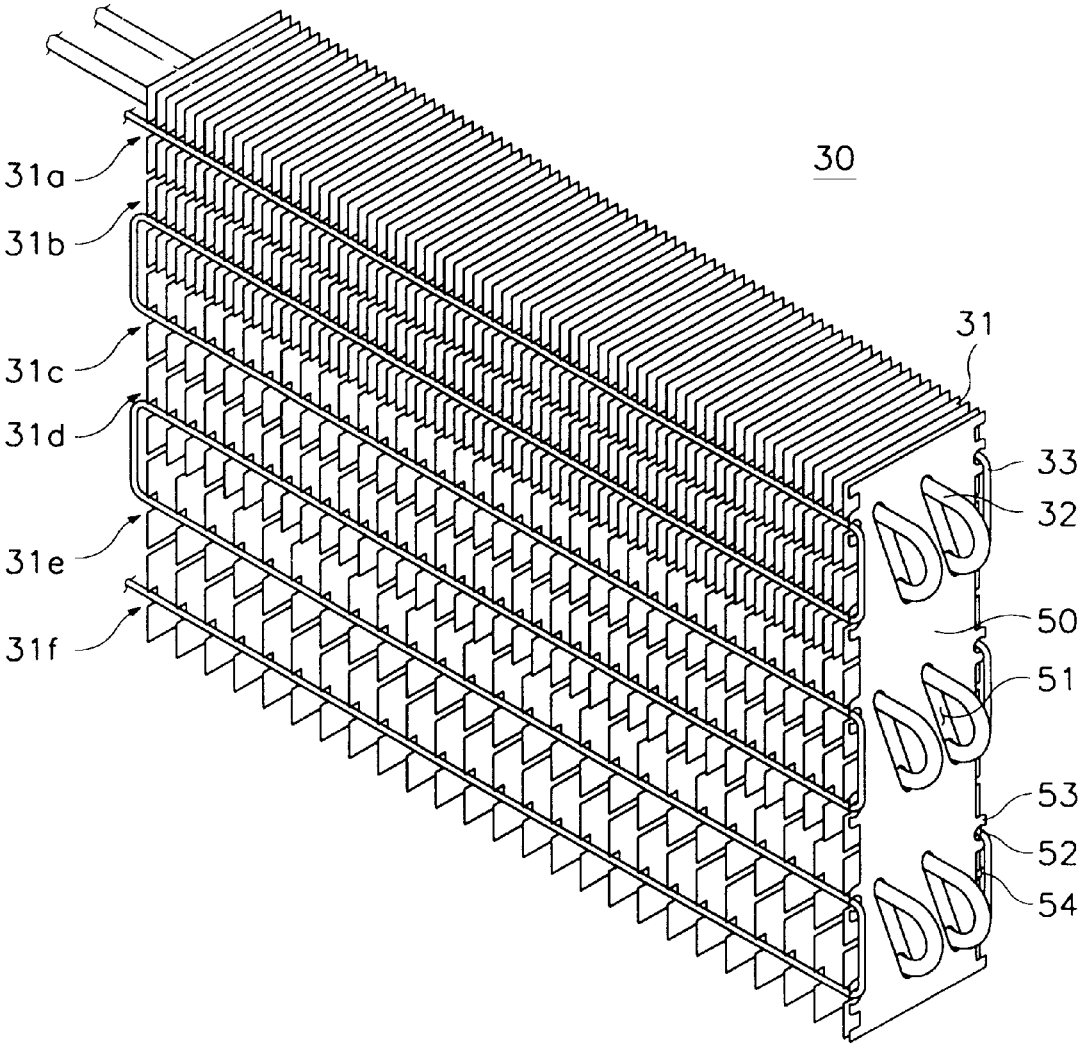
FIG. 13 shows a defrosting heater mounting step in a manufacturing method of a heat exchanger.

Finally, in the defrosting heater mounting step S8, as shown in FIG. 13, the defrosting heater 33 is mounted into the recesses 35 of the fins 31 and the mounting recesses 52 of the auxiliary plates 50. After the defrosting heater 33 is mounted as above, a couple of protrusions 53 forming the mounting recess 52 are bent or deformed onto the defrosting heater 33. As a result, the auxiliary plates 50 are mounted to the front/rear of the heat exchanger 30.

The inventive heat exchanger 30 is produced by such a series of steps.

The operation and effect of the inventive heat exchanger 30, when it is used as a evaporator in a refrigerator, will be described hereinafter with reference to FIGS. 14 and 4.

Figure 14:
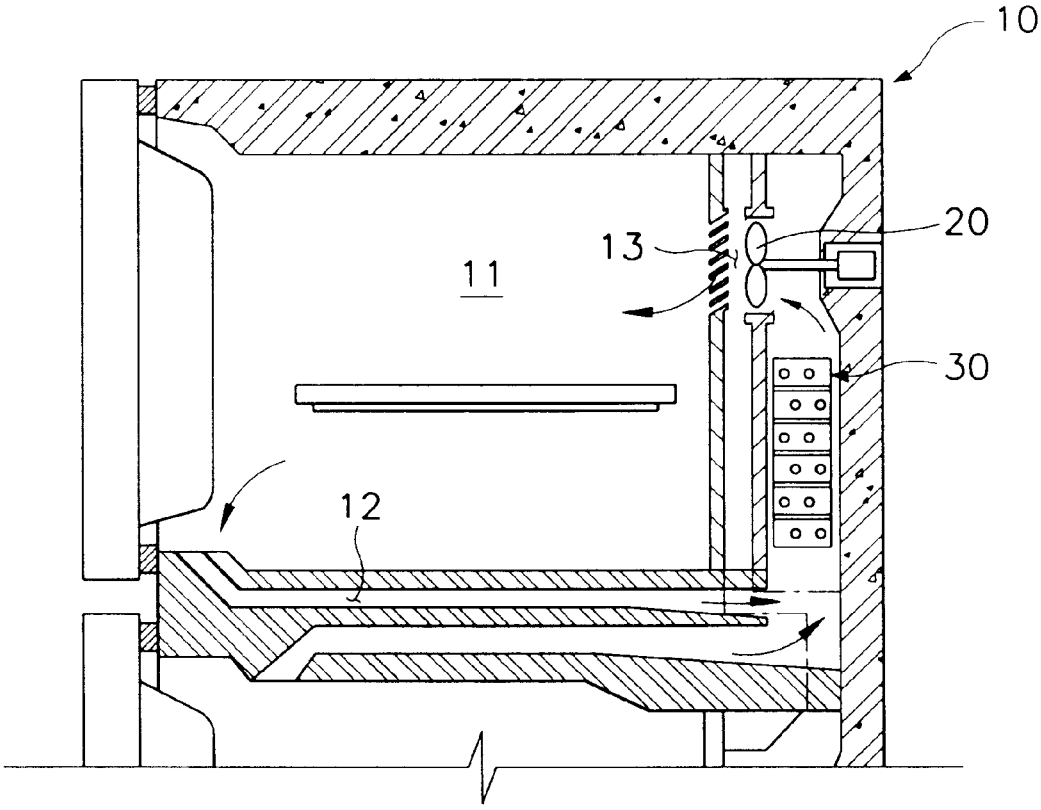
FIG. 14 is a sectional view of a refrigerator with a heat exchanger according to a preferred embodiment of the present invention.

As shown in FIG. 14, when a fan 20 and a compressor (not shown) operate by power supplied to a refrigerator 10, air in a storage chamber 11 of the refrigerator is forwarded toward the bottom of the heat exchanger 30 through a return duct 12 and passes over the fins 31 and the pipes 32 through which the refrigerant flows, thereby realizing heat exchange. Since the outer circumferential surface of the pipe 32 is in a surface contact with the burrs 34*a* (see FIG. 6) formed on the through-holes 34 of the fins 31, the heat exchange efficiency is enhanced.

Subsequently, cool air which passed over the heat exchanger 30 is supplied to the storage chamber 11 through a guide duct 13 by the fan 20 so as to refrigerate food stored in the chamber 11. This cool air is then directed toward the heat exchanger 30 through the return duct 12 over and over again, thereby food being kept fresh.

Air directed toward the inventive heat exchanger 30 by the fan 20 is dispersed as it contacts the pipe portions which are disposed on the lowermost fin, and thus contacts effectively with the pipe portions which are disposed above the lowermost pipe portions in the zigzag shape or progression, as shown in FIG. 4. As a result, since air passing through the heat exchanger 30 mostly contacts all of the pipe portions of the pipes 32, an area of heat transmission is increased and the heat exchange efficiency is greatly improved.

Further, since each pipe 32 is elliptically-shaped in cross section and mounted to the fins 31 in such a manner that the long axis Y of the pipe 32 is parallel to the direction of air flow, the passage for the air becomes broader (has a larger cross section) as compared with the conventional heat exchanger 1 (see FIG. 2), thereby reducing the pressure loss of air and the consumption power and operating noise of the fan 20.

Also, by this figuration of the pipes 32, defrosted droplets are more easily exhausted from the pipes 32. In particular, because humid air in the storage chamber 11 is directed toward the heat exchanger 30, condensation and frost mostly generate on the facing surfaces of the pipes 32. When this occurs, the defrosting process is carried out by the defrosting heater 33, and the condensed water generated during the defrosting process is better able to be exhausted from the pipes 32 because the (facing) contact area between the pipes 32 and the condensed water is small compared to that of a round pipe.

While this invention has been described in connection with the split-fin type heat exchanger in which a plurality of fins are arranged in groups and the fin groups are piled in layers along the direction of air flow, it is to be understood that the invention is not limited to the disclosed embodiment, but, on the contrary, is intended to cover the integral-fin type heat exchanger in which a plurality of fins are arranged in parallel with each other in one layer.

As described above in detail, the heat exchanger and manufacturing method thereof according to this invention have advantages in that the pressure loss of air is reduced and condensed water is easily exhausted during the defrosting process because the pipe rows have a zigzag shape along the direction of air flow and the pipe is elliptically-shaped, thereby enhancing the heat exchange efficiency.

What is claimed is:

1. A method for manufacturing a heat exchanger comprising the steps of:

preparing fins having respective first and second through-holes through which respective first and second pipes are inserted;

arranging the fins depth-wise in parallel with each other and depth-wise in several separated groups;

inserting the first and second pipes through the respective first and second through-holes of the fins of the fin groups such that respective first and second inner pipe portions of the first and second pipes are disposed in the fin groups and respective first and second outer pipe portions of the first and second pipes are located between the fin groups;

bending the outer pipe portions of the pipes so that the fin groups separated from each other thereby are piled in layers along a longitudinal direction of air flow and the first and second inner pipe portions of the pipes are arranged in respective first and second pipe rows which are coplanar along the longitudinal direction of air flow; and wrenching the bent outer portions of the pipes to form each pipe row into a zigzag shape.

2. A method for manufacturing a heat exchanger as claimed in claim 1:

wherein the preparing step further comprises the step of forming the pipes in an elliptical cross-sectional shape which has a short axis and a long axis; and wherein the fin arranging step further comprises the step of inserting the pipes into the fin groups with the long axis of the pipe parallel to the longitudinal direction of air flow.

3. A method for manufacturing a heat exchanger as claimed in claim 1:

wherein the preparing step further comprises the step of forming the first and second through-holes on a portion biased in a lateral direction from a longitudinal center of the fins; and wherein the fin arranging step further comprises the step of alternately arranging the fin groups to have the through-holes formed on a laterally left-biased portion thereof and on a laterally right-biased portion thereof.

4. A method for manufacturing a heat exchanger as claimed in claim 1, wherein the providing step further comprises the step of forming a burr on a surrounding portion of each through-hole to provide a surface contact thereof with an outer circumferential surface of the pipe subsequently inserted therethrough.

5. A method for manufacturing a heat exchanger as claimed in claim 1, wherein the method further comprises, between the fin arranging step and the pipe bending step, the step of expanding each pipe so that an outer circumferential surface of the pipe adheres closely to an inner circumferential surface of the associated through-hole.

6. A method for manufacturing a heat exchanger as claimed in claim 1, wherein the method further comprises the step of fixedly mounting respective auxiliary plates having fixing holes through which the bending portion of the pipes are inserted to a depth-wise front and rear of the layered fin groups after the wrenching step.

7. A method for manufacturing a heat exchanger as claimed in claim 2:

wherein the preparing step further comprises the step of forming the first and second through-holes on a portion biased in a lateral direction from a longitudinal center of the fins; and wherein the fin arranging step further comprises the step of alternately arranging the fin groups to have the through-holes formed on a laterally left-biased portion thereof and on a laterally right-biased portion thereof.

* * * * *